US012232642B2

(12) United States Patent
Goenka et al.

(10) Patent No.: US 12,232,642 B2
(45) Date of Patent: Feb. 25, 2025

(54) DUVET COVER

(71) Applicant: WELSPUN LIVING LIMITED, Mumbai (IN)

(72) Inventors: Dipali Goenka, Mumbai (IN); Subrata Palit, Gujarat (IN)

(73) Assignee: WELSPUN LIVING LIMITED, Mumbai (IN)

( * ) Notice: Subject to any disclaimer, the term of this patent is extended or adjusted under 35 U.S.C. 154(b) by 194 days.

(21) Appl. No.: 17/703,372

(22) Filed: Mar. 24, 2022

(65) Prior Publication Data

US 2022/0304485 A1 Sep. 29, 2022

Related U.S. Application Data

(60) Provisional application No. 63/165,189, filed on Mar. 24, 2021.

(51) Int. Cl.
*A47G 9/02* (2006.01)

(52) U.S. Cl.
CPC ..... *A47G 9/0207* (2013.01); *A47G 9/0261* (2013.01)

(58) Field of Classification Search
CPC ..... A47G 9/0207; A47G 9/0261; A47G 2009/0269; A47G 9/04; A47C 21/028
USPC ..... 5/482, 501, 496, 424, 488
See application file for complete search history.

(56) References Cited

U.S. PATENT DOCUMENTS 10,349,762 B2 7/2019 Steinbock

FOREIGN PATENT DOCUMENTS

| | | | | |
|---|---|---|---|---|
| DE | 102010046782 A1 | | 12/2011 | |
| FR | 2888738 A1 | | 1/2007 | |
| GB | 2415371 A | * | 12/2005 | ..... A47G 9/0207 |
| WO | WO 2012007037 A1 | | 1/2012 | |

OTHER PUBLICATIONS

Enlightened Equipment—Revelation Custom Sleeping Quilt—www.youtube.com/watch?v=zdre_XScCGE (Year: 2017).*
Extended European search report, pursuant to Rule 62 EPC, issued in related European application No. 22164184.8, mailed Jul. 29, 2022 (7 pgs.).

* cited by examiner

*Primary Examiner* — David R Hare
*Assistant Examiner* — Madison Emanski
(74) *Attorney, Agent, or Firm* — FINNEGAN, HENDERSON, FARABOW, GARRETT & DUNNER, LLP

(57) ABSTRACT

The present disclosure provides duvet covers and methods for covering duvets. The duvet cover defines a cavity for receiving a duvet insert, the cavity accessible via an opening at a first edge of the duvet cover. The duvet cover comprises at least one cord inside the cavity within the duvet cover, the at least one cord extending between a second edge of the duvet cover, remote from the first edge of the duvet cover, and the first edge of the duvet cover; and a plurality of holders attached on the inside of the duvet cover, the plurality of holders holding the at least one cord such that pulling on a portion of the at least one cord, proximate to the opening, causes at least a part of the second edge the duvet cover to be brought closer to the first edge of the duvet cover.

20 Claims, 14 Drawing Sheets

DUVET COVER

PRIORITY CLAIM

This U.S. patent application claims priority under 35 U.S.C. § 119 to: U.S. provisional patent application No. 63/165,189, filed on Mar. 24, 2021. The entire contents of the aforementioned application are incorporated herein by reference for all purposes.

TECHNICAL FIELD

The present disclosure generally relates to apparatus and methods for covering bedding layers. More particularly, and without limitation, the disclosed embodiments relate to duvet covers and methods for covering duvets.

BACKGROUND

A duvet cover is a protective layer of material that slips over a duvet and has a closure. That is, a duvet cover defines a cavity for receiving a duvet, comforter, or any other kind of duvet inserts. Duvets, duvet inserts, and comforters can be expensive and difficult to clean, and duvet covers protect a duvet insert or comforter during use and can be removed and can be easy to wash. A duvet insert should fit snugly inside a duvet cover, which can be removed and washed when needed. Duvet covers can also quickly and easily change the appearance of a bed and room without having to completely redecorate the bed of room.

A duvet is a soft flatter version of a comforter which may be manufactured with down, feathers, or synthetic fiber, and duvets may be intended to be used as an insert. Duvets may commonly be white in color, not quilted, or decorative. Duvet inserts, such as duvets may be sold separately from duvet covers, giving the purchaser the freedom to mix and match their bedding.

The duvet cover protects the duvet from dirt, body fluids, damage, and spills. Duvet covers come in a variety of colors, prints, fabric, and styles. Duvet covers may be enclosed with buttons or a zipper and some duvet covers include corner ties to hold the duvet insert in place.

Duvet covers may be made from cellulosic fiber like cotton, and cotton is an easy-to-maintain fabric that is soft and comfortable. Other materials and fibers such as Polyester, nylon, Silk, wool, viscose, Tencel, Bamboo, Linen, Hemp, blends of fibers are also used to make fabrics for duvet covers. Duvet Covers can be solid, striped with dyed yarn during weaving or printed fabrics.

Duvet covers may be constructed with two fabric layers, or single fabric layer folded, and the sides of the fabric layers, or folded fabric layer, may be stitched together. Examples of stitching may include a five-thread safety stitch (ISO 516) or by SNLS (ISO 301) pivot at top corners with ⅜ inch to ½ inch seam allowance and three thread overlock (ISO 504).

A bottom side of the duvet cover may also be referred to as the opening side of the duvet cover because the bottom side may have an opening where a duvet insert may be inserted into the duvet cover. In the bottom side of the duvet cover, there may be six-inch panel folded in half and stitched with SNLS (ISO 301). The six or eight inch width from both sides may be referred to as the shoulder of the duvet cover.

The remaining width in the bottom side of the duvet covers are called the duvet opening area where both layers of the fabric are not stitched together. Buttons or zippers may be attached to close the bottom side of the duvet cover after filling the duvet inside the duvet cover.

Inside the four corners of the duvet cover may include corner ties that may be attached to the corners which can connect to or be tied to corner loops on a duvet insert. Corner ties may assist in keeping the duvet insert in place properly within the duvet cover.

The inventors here have recognized that conventional duvet covers have several challenges. First, installing a duvet cover over a duvet inset is a challenging task because duvet inserts are large and can be difficult to manage, and can be even more difficult to situate correctly inside of a duvet cover. This task is especially difficult for a single person to accomplish on their own.

The inventors here have also recognized that current solutions to these challenges include methods of using conventional duvet covers which can require several steps and may be time consuming. Examples of such methods include, turning the duvet covers inside out and laying the duvet cover flat against bed, then laying the duvet on the duvet covers, then tying the corner loops, then begin rolling both fabrics like burrito, after reaching to the end of comforter stuffing one end inside the final lip of the duvet fabric, repeat the process in other end, flip over the middle too, and finally unroll the duvet burrito. This method is complicated, time consuming, and may not result in the proper placement of the duvet insert within the duvet cover.

The technical problems addressed by the present disclosure include overcoming these difficulties by creating bedding covers, duvet covers, and methods for covering duvets that address some or all of the above-discussed difficulties. Advantageously, the exemplary embodiments allow for fast, controlled, and uniform placement of duvet inserts within a duvet cover. The solution to this technical problem is provided by the embodiments described herein and characterized in the claims.

SUMMARY

The embodiments of the present disclosure include bedding covers, duvet covers, and methods for covering duvets. Advantageously, the exemplary embodiments allow for fast, controlled, and uniform placement of duvet inserts within a duvet cover.

According to some embodiments, a duvet cover is provided. The duvet cover defines a cavity for receiving a duvet insert, the cavity accessible via an opening at a first edge of the duvet cover. The duvet cover comprises: at least one cord inside the cavity within the duvet cover, the at least one cord extending between a second edge of the duvet cover, remote from the first edge of the duvet cover, and the first edge of the duvet cover; and a plurality of holders attached on the inside of the duvet cover, the plurality of holders holding the at least one cord such that pulling on a portion of the at least one cord, proximate to the opening, causes at least a part of the second edge the duvet cover to be brought closer to the first edge of the duvet cover.

The first edge and the second edge of the duvet cover may be connected by a third edge and a fourth edge of the duvet cover.

The at least one cord may comprise a first cord adjacent to the third edge of the duvet cover and a second cord adjacent to the fourth edge of the duvet cover, where pulling on a portion of each of the first and second cords, proximate to the opening, may cause the third edge and the fourth edge of the duvet cover to concertina.

The plurality of holders is a plurality of loops may be spaced along each of the third edge and fourth edge of the duvet cover, wherein the first and second cords may be threaded through the corresponding loops.

An equal number of the plurality of loops may be uniformly spaced along each of the third edge and the fourth edge of the duvet cover.

The duvet cover may comprise a first layer and a second layer joined by seams along the third edge and the fourth edge respectively to form the cavity of the duvet cover.

The plurality of holders may be attached on the inside of the duvet cover by being one or more of: secured at the seams, in between the first layer and the second layer of the duvet cover; stitched to the first layer; stitched to the second layer; or stitched to the first and second layers.

The least one cord may be attached on the inside of the duvet cover at the first edge, or at the second edge, or at first and second edges.

For each of the at least one cord, the duvet cover may comprise a fastener coupled with the cord and configured to maintain the cord at a desired length.

The fastener may be a toggle, a clamp, a clip, or a tie.

For each of the at least one cord, the fastener may be attached on the inside of the duvet cover.

For each of the at least one cord, a cord opening may be defined in the duvet cover at the second edge such that the respective cord extends from within the cavity of the duvet cover through the cord opening. The corresponding fastener may be coupled with the cord outside the cavity of the duvet cover.

For each of the at least one cord, the fastener may be attached on an outside of the duvet cover.

Each fastener may be attached to the duvet cover via a fastener tab secured at a seam joining a first layer and a second layer forming the cavity of the duvet cover.

The duvet cover may comprise a plurality of fixings attached on the inside of the duvet cover for assisting with keeping the duvet insert positioned inside the cavity of duvet cover, at least two of the plurality of fixings attached on the inside of the duvet cover proximate to the second edge of duvet cover.

The plurality of fixings may comprise at least two fixings attached proximate to the first edge.

The plurality of fixings may be a plurality of ties or buttons positioned at corners of the duvet cover for coupling with corresponding loops positioned at corners of the duvet insert.

Each of the at least one cord may be made from cotton, polyester, blended fibers, or any combination thereof.

Also, an apparatus and methods for duvet covers are provided. The duvet cover can include a front fabric layer, a back fabric layer connected to the front fabric layer along one or more sides of the front layer and the back layer, an opening at a bottom surface (or edge) of the duvet cover between the front fabric layer and back fabric layer, at least one loop connected to an interior side surface of the duvet cover, at least one cord extending through the at least one loop and extending between a top surface (or edge) and a bottom surface (or edge) of the duvet cover. The opening is configured to receive a duvet insert within the duvet cover.

Additional features and advantages of the disclosed embodiments will be set forth in part in the description that follows, and in part will be obvious from the description, or may be learned by practice of the disclosed embodiments. The features and advantages of the disclosed embodiments will be realized and attained by the elements and combinations particularly pointed out in the appended claims.

It is to be understood that both the foregoing general description and the following detailed description are examples and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

DETAILED DESCRIPTION

Reference will now be made in detail to embodiments and aspects of the present disclosure, examples of which are illustrated in the accompanying drawings. Where possible, the same reference numbers will be used throughout the drawings to refer to the same or like parts.

Figure 1:
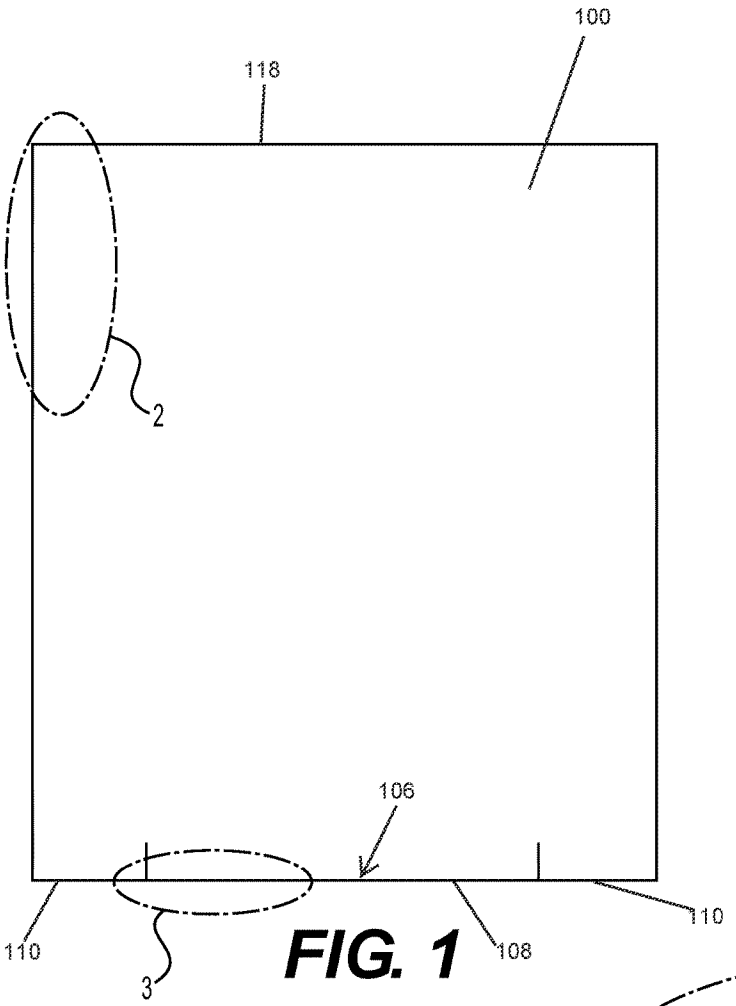
FIG. 1 is a front view of an exemplary duvet cover, according to embodiments of the present disclosure.
Figure 2:
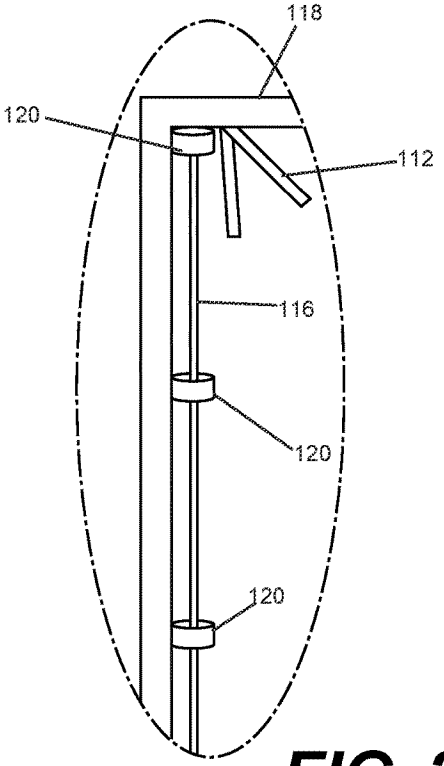
FIG. 2 is a detailed interior front view of an interior of area 2 of the duvet cover of FIG. 1.
Figure 3:
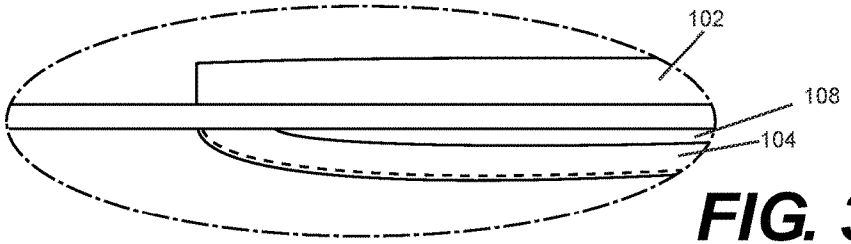
FIG. 3 is a detailed bottom view of the area 3 of the duvet cover of FIG. 1.

FIGS. 1-3 illustrate an exemplary embodiment of a duvet cover 100 consistent with embodiments of the present disclosure. Duvet cover 100 may be configured to receive and surround a duvet insert and may protect the duvet insert from dirt, body fluids, damage, and spills. Duvet cover 100 may be enclosed with buttons, a zipper, ties, or any other suitable closure mechanisms. In some embodiments, duvet cover 100 may be of cellulosic fiber like cotton. In other embodiments, duvet cover may include one or more of Polyester, nylon, Silk, wool, viscose, Tencel, Bamboo, Linen, Hemp, blends and combinations thereof. Duvet cover 100 may include a solid color finish or may be a printed fabric.

Duvet cover 100 may include two fabric layers including a front layer 102 and a back layer 104, and front layer 102 and back layer 104 may be stitched together along the respective sides of the front layer 102 and back layer 104 by a five-thread safety stitch (ISO 516) or by SNLS (ISO 301) pivot at the top corners with ⅜ inches to ½ inch seam allowance and three thread overlock (ISO 504). In some embodiments, layers 102 and 104 are part of the same piece of fabric folded to form duvet cover 100 and stitched together along the respective sides of front layer 102 and back layer 104 by a five-thread safety stitch (ISO 516) or by SNLS (ISO 301) pivot at the top corners with ⅜ inches to ½ inch seam allowance and three thread overlock (ISO 504). Layers 102 and 104 of duvet cover 100 define a cavity of duvet cover 100 for receiving a duvet insert.

A bottom surface or edge 106 of duvet cover 100 may also be referred to as the opening side of duvet cover 100 because bottom surface or edge 106 may have an opening 108 where a duvet insert may be inserted into duvet cover 100 (into a cavity of duvet cover 100). In bottom surface 106 of duvet cover 100, there may be six-inch panel folded in half and stitched with SNLS (ISO 301). Opening 108 may extend across a portion of bottom surface or edge 106, and bottom surface 106 may include a shoulder 110 on both sides of opening 108 between opening 108 and the respective ends of bottom surface or edge 106. Each shoulder 110 may extend inward from the edge of bottom surface 106 at any suitable width. Non-limiting examples of the width each shoulder 110 may extend inward on bottom surface 106 includes six- or eight-inch width from both sides.

The remaining width of bottom surface or edge 106 of duvet cover 100 may be opening 108 between shoulders 110 and opening 108 is where front layer 102 and back layer 104 are not stitched together, as shown in FIG. 3. Buttons or zippers may be attached to either front layer 102 or back layer 104 or to both layers 102, 104 to close opening 108 in bottom surface 106 of duvet cover 100 after positioning the duvet insert inside duvet cover 100. In some embodiments, duvet cover 100 may be enclosed with buttons, a zipper, ties, or any other suitable closure mechanisms. In some embodiments, opening 108 may extend across the entire width of duvet cover 100 such that duvet cover 100 does not include shoulders 110.

FIG. 2 illustrates a detailed interior front view of an interior of area 2 of duvet cover 100, and shows that duvet cover 100 may further include one or more fixings or fixing means, such as ties 112, placed throughout duvet cover 100. Ties 112 may be attached to either front layer 102 or back layer 104 or to both layers 102, 104. Ties 112 may be attached by stitching to front layer 102, back layer 104, or both, or secured at seams in between front layer 102 and back layer 104, formed from stitching front layer 102 and back layer 104 to define the cavity of duvet cover 100.

In some embodiments, ties 112 are positioned inside duvet cover 100 and may be positioned at or near each internal corner of duvet cover 100. Ties 112 may be attached and/or tied to respective corresponding corner loops on a duvet insert. Ties 112 may assist in keeping the duvet insert in place properly within duvet cover 110 by securing each respective corner of the duvet insert to ties 112 positioned at or near the corners of duvet cover 100. Other fixings can be used instead of, or an addition to, ties 112, such as clasps, clips, or buttons for coupling with respective corner loops on a duvet insert or directly with respective corners of the duvet insert.

Having a fixing corresponding to each corner of the duvet insert would assist better with keeping the duvet insert in place in duvet cover 100 than having fixings for some, but not all, of the corners of the duvet insert. However, having at least two fixings proximate to top surface or edge 118 for securing the duvet insert within the cavity of duvet cover 100 would facilitate pulling of duvet cover 100 over the duvet insert in a uniform and controlled manner, until the duvet insert is contained within duvet cover 100.

Duvet cover 100 may further include one or more cords 116 that may be connected to an inside surface of duvet cover 100. Cords 116 may be attached to or held at each side or edge 114 of duvet cover 100 along the length of duvet cover, and cords 116 may be anchored in top surface or edge 118 and bottom surface or edge 106 of duvet cover 100, and may extend between top surface or edge 118 and bottom surface or edge 106. Cords 116 may be attached to or held at either front layer 102 or back layer 104 or to both layers 102, 104. Cords 116 may be held at either front layer 102 or back layer 104 or to both layers 102, 104 using holders or holding means, such as loops, clamps, clasps, or clips attached to front layer 102 or back layer 104, or to both layers 102, 104, for example, by stitching, or secured at seams in between front layer 102 and back layer 104, formed from stitching front layer 102 and back layer 104 to define the cavity of duvet cover 100. For example, cords 116 may pass through one or more loops 120 connected to each side of duvet cover 100 and positioned along the length of each side of duvet cover 100. Cords 116 may be made from any suitable material, and non-limiting examples of materials can include Cotton, Polyester, blended fibers, and combinations thereof. Cords 116 can be made of any suitable length for any size duvet cover 100 so that cords 116 can extend from top surface or edge 118 to bottom surface 106. The diameters of cords 116 can be any suitable diameter including, but not limited to ⅛ inch, ¼ inch, ⅜ inch, ½ inch, or any other suitable diameter depending on the requirements.

Loops 120 may be connected to each side of duvet cover 100 and positioned along the length of each side of duvet cover 100. Loops 120 may be attached to either front layer 102 or back layer 104 or to both layers 102, 104. Duvet cover 100 may include any suitable number of loops 120, and loops 120 may be evenly spaced apart along the length of duvet cover 100 such that each side of duvet cover 100 includes an equal number of loops 120 uniformly spaced along the length of the side. Each loop 120 may extend outwardly from the side of duvet cover 100 and may include any suitable shape to receive cords 116 through each loop 120. In some embodiments, loops 120 may be stitched to the side of duvet cover 100 to ensure loops 120 remain at each respective position along the length of duvet cover 100. Cords 116 threaded through each series of loops 120 may allow duvet cover 100 to be pulled and released uniformly from each side.

Figure 4A:
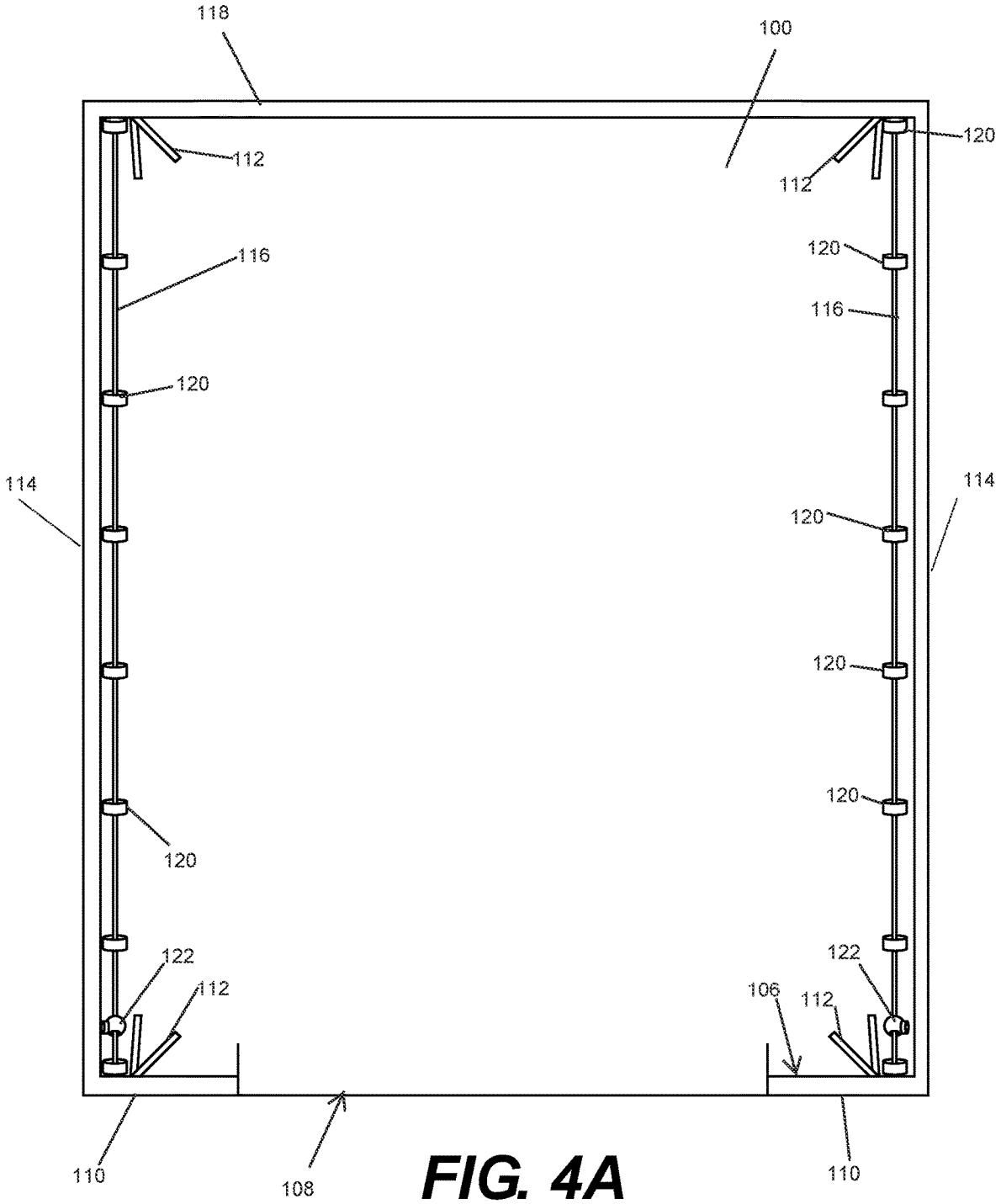
FIG. 4A is a front interior view of a duvet cover, consistent with embodiments of the present disclosure.

FIG. 4A illustrates an exemplary front interior view of duvet cover 100. Cords 116 extend from top surface or edge 118 to bottom surface or edge 106, each cord 116 is threaded through a series of loops 120 spaced apart along the length of duvet cover 100. In some embodiments, cords 116 may be connected to both top surface or edge 118 and bottom surface or edge 106. In other embodiments, cords 116 may be connected to one of top surface or edge 118 or bottom surface or edge 106.

FIGS. 4A, 4B, and 5-7 illustrate that, in some embodiments, duvet cover 100 may further include one or more fasteners 122 that may be connected to each cord 116. One or more fasteners 122 may receive cord 116 though fastener 122, and fastener 122 may be configured to hold cord 116 at a designated length. In some embodiments, one or more fasteners 122 may be a spring-loaded toggle that receives cord through an opening in the fastener 122, and an internal spring within the toggle may actuate an internal arm to engage with cord 116 and retain cord 116 in place until fastener 122 is released. In other embodiments, fasteners 122 can be any mechanism for retaining cords 116 and maintaining cord 116 at a desired length. Non-limiting examples of fasteners 122 include toggles, clamps, clasps, clips, ties, or any other suitable mechanism.

Fasteners 122 may be connected to duvet cover 100 by a fastener tab 130 that extends from duvet cover 100 to fastener 122. Fastener tab 130 may be attached, e.g., stitched, to either front layer 102 or back layer 104 or to both layers 102, 104. Fastener tab 130 may be secured at a seam joining first or front layer 102 and second or back layer 104. In some embodiments, fastener tab 130 may be positioned at or near bottom surface or edge 106 of duvet cover 100 which connects fastener 122 to duvet cover 100 at or near bottom surface 106.

Figure 4B:
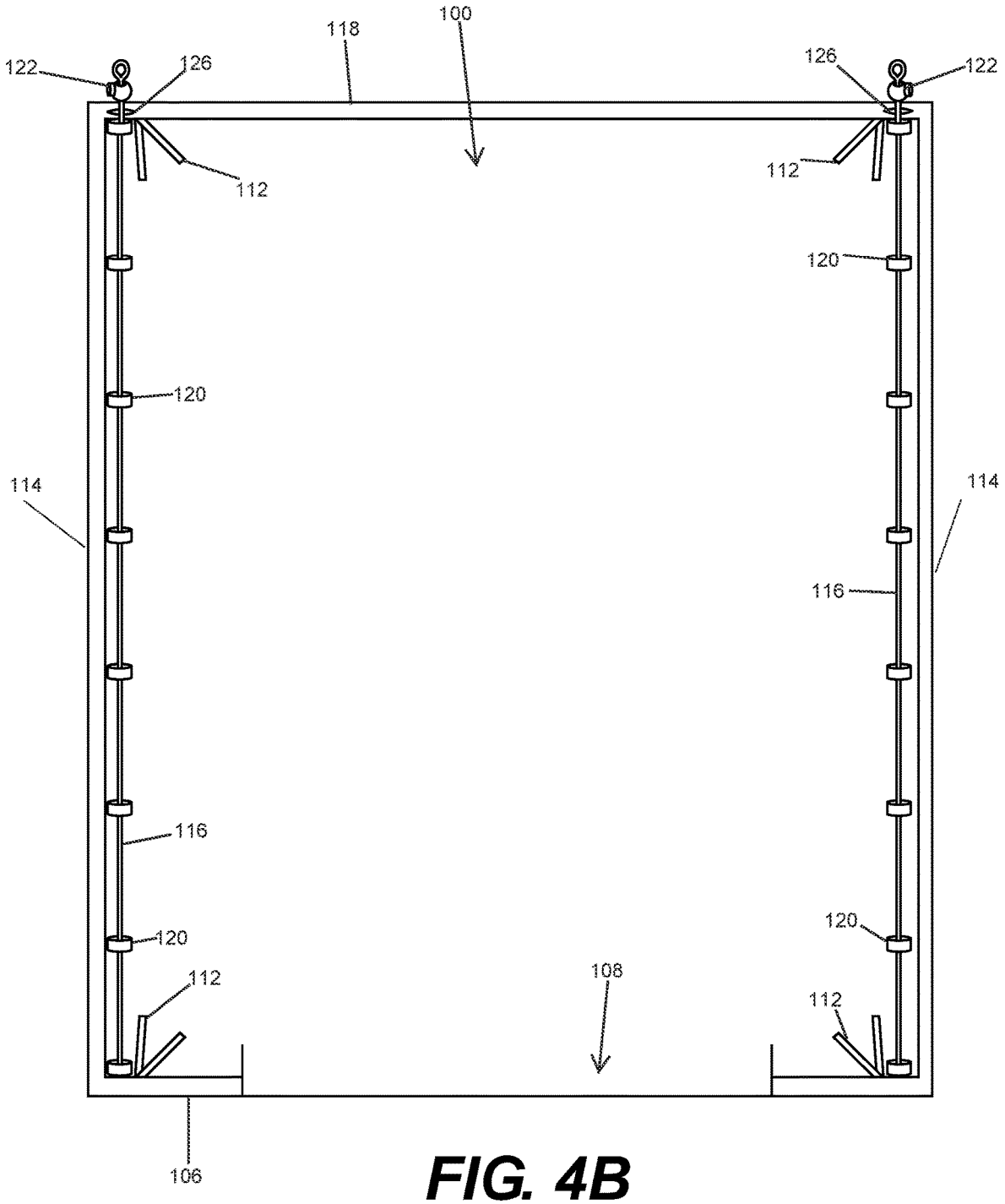
FIG. 4B is a front interior view of a duvet cover, consistent with embodiments of the present disclosure.
Figure 5:
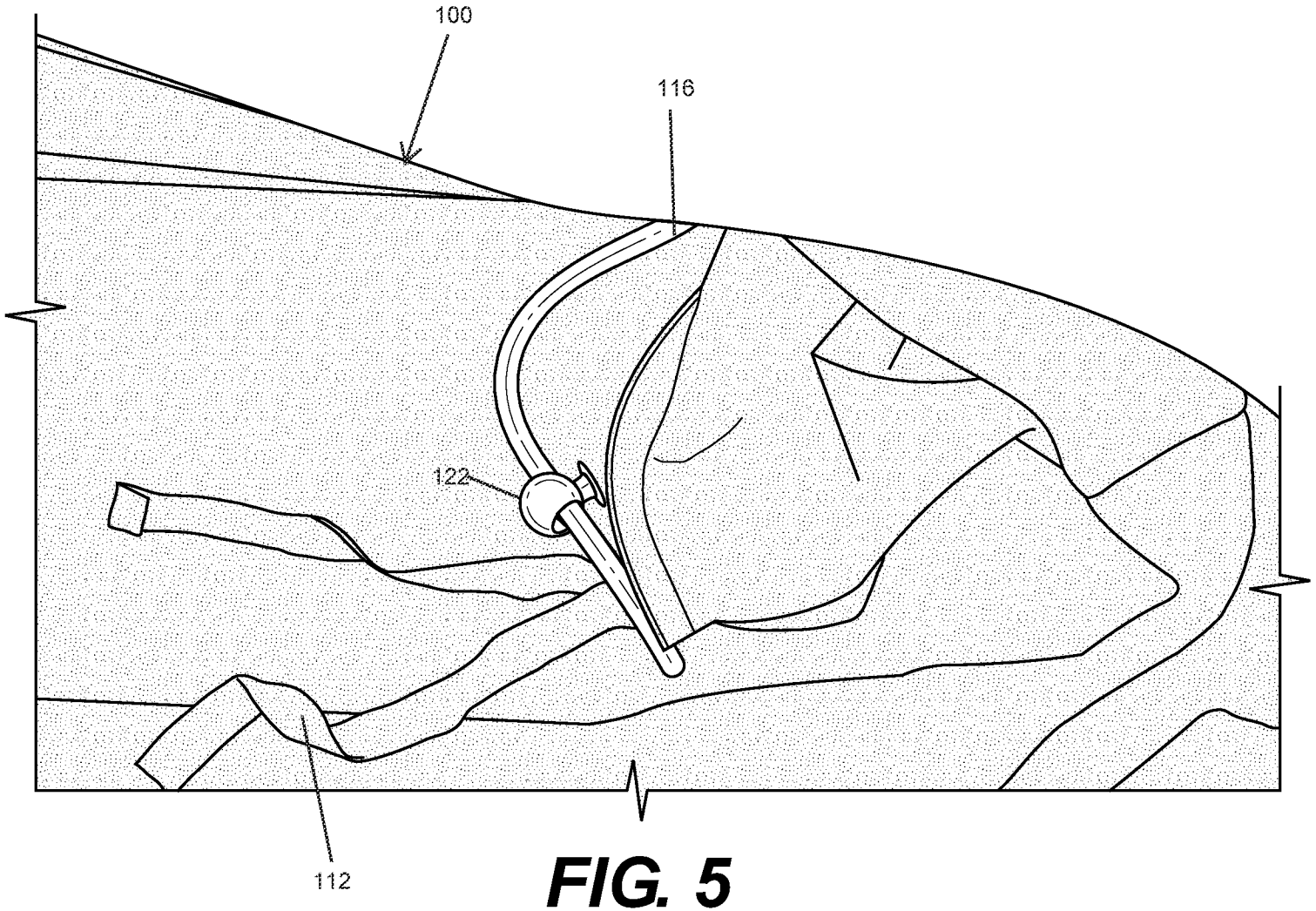
FIG. 5 is a detailed perspective view of a corner section of a duvet cover, consistent with embodiments of the present disclosure.
Figure 6:
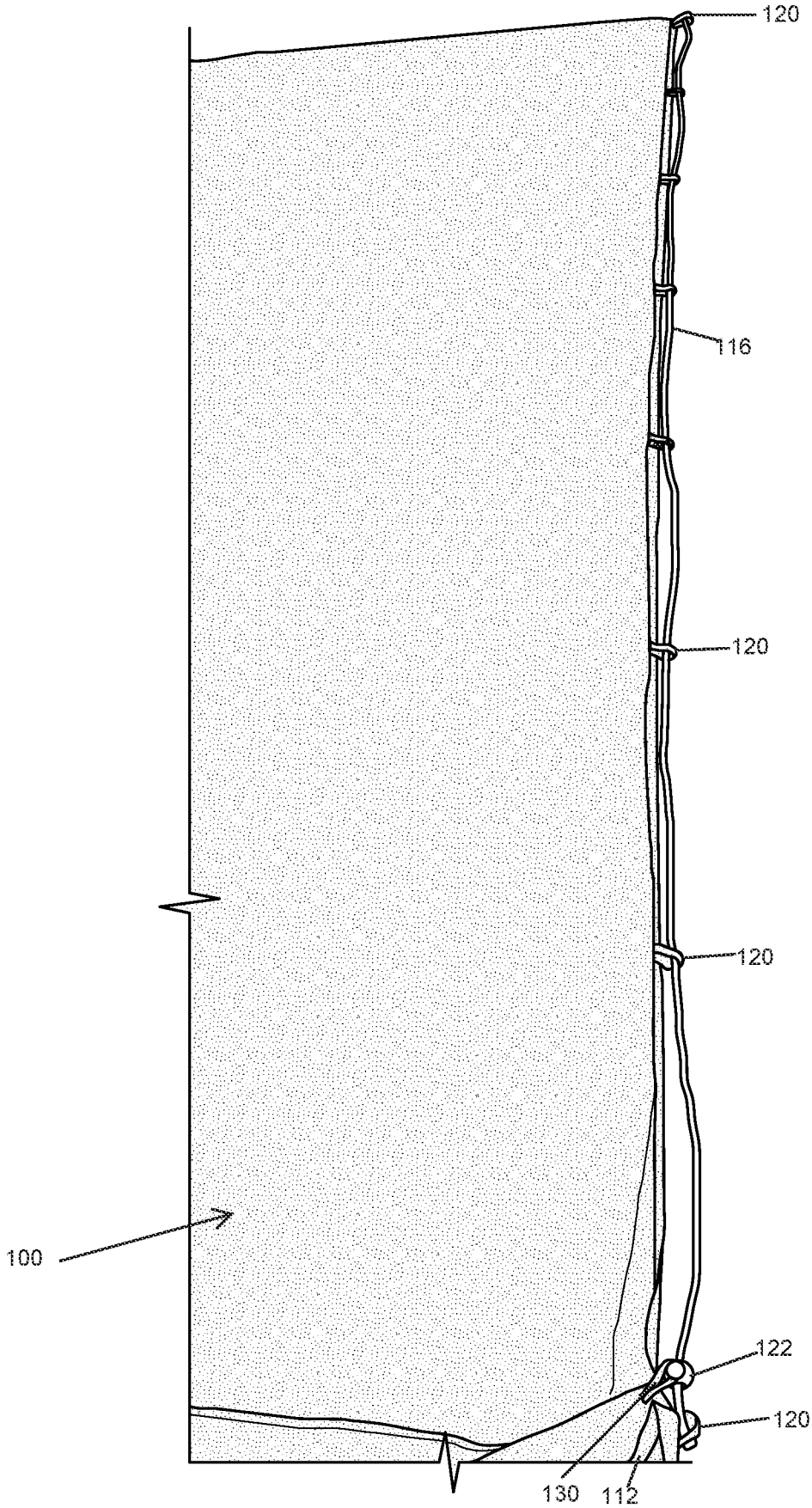
FIG. 6 is a front, interior sectional view of the duvet cover of FIG. 4.
Figure 8:
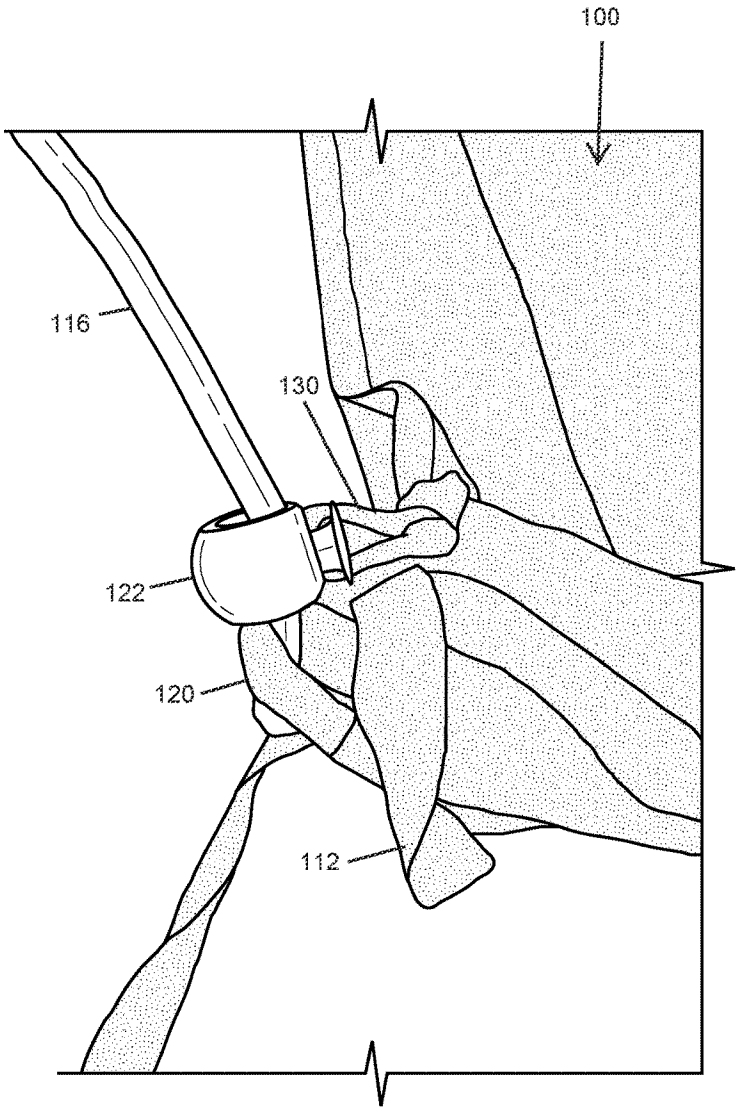
FIG. 8 is a detailed perspective view of a corner section of a duvet cover, consistent with embodiments of the present disclosure.
Figure 7:
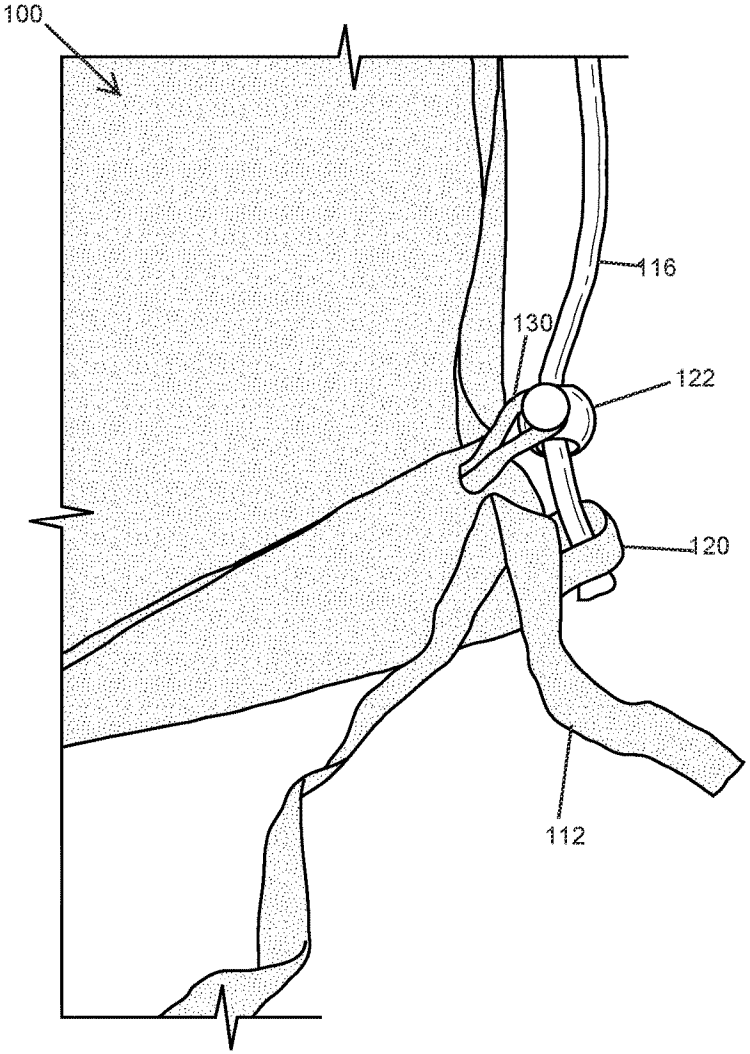
FIG. 7 is a detailed perspective view of a corner section of a duvet cover, consistent with embodiments of the present disclosure.

FIG. 4B illustrates another front interior view of an alternative embodiment of duvet cover 100 that has one or more cord openings 126 in top surface or edge 118. In some embodiments, each cord 116 may have a respective cord opening 126 that cord 116 may extend though. The cord opening 126 may be dimensioned to receive the diameter of cord 116 through the opening, and may also be dimensioned to receive the diameter of fastener 122 though the opening 126. As illustrated in FIG. 4B, each cord 116 is connected to bottom surface or edge 106 of duvet cover 100, extends through loops 120, and extends through cord openings 126 in top surface or edge 118.

Now that the components of duvet cover 100 have been described, the respective functions of the components can be understood. A duvet insert may be positioned within duvet cover 100 without turning duvet cover inside-out. To position the duvet insert within duvet cover 100, a user may place duvet cover 100 over the duvet insert and may pull cords 116 from one or both sides, depending on an implementation (e.g., compare examples of FIGS. 4A and 4B), to gather duvet cover 100 into a compact arrangement where top surface or edge 118 may be easily accessed. For example, with reference to FIG. 4A, pulling each cord, e.g., proximate to opening 108, would cause the edges of duvet cover 100 to concertina (e.g., to fold or be pushed together), reducing the overall distance between top surface or edge 118 and bottom surface or edge 106. Similarly, with reference to FIG. 4B, pulling each cord, e.g., by pulling on the ends of cords 116 away from top surface or edge 118 would cause the edges of duvet cover 100 to concertina (e.g., to fold or push together), reducing the overall distance between top edge or surface 118 and bottom surface or edge 106.

In some embodiments, in the example of FIG. 4B, each cord may be pulled on both sides, i.e., proximate to top surface of edge 118 and bottom surface or edge 106. To secure a cord at a desired length in a scenario where the cord is being pulled on both sides, at least two fasteners may be included, one on each end of the cord.

With top surface or edge 118 accessible, the user may connect duvet cover 100 to the duvet insert by connecting ties 112 connected to top edge or surface 118 to loops on one end of the duvet insert, thereby securing the duvet insert within duvet cover 100. After the duvet insert is connected to ties 112 in top edge or surface 118, the user can use fasteners 122 to release cords 116 such to allow fasteners 122 move freely about cords 116, thereby allowing duvet cover 100 to be pulled over the duvet insert in a uniform manner until the duvet insert is contained within duvet cover 100. The user can then connect the other end of the duvet insert to ties 112 in bottom surface or edge 106 of duvet cover 100 and may close opening 108.

In some embodiments, one or more fasteners 122 may be a spring-loaded toggle that receives cord through an opening in fastener 122, and an internal spring within the toggle may actuate an internal arm to engage with cord 116 and retain cord 116 in place until fastener 122 is released. In other embodiments, fasteners 122 can be any mechanism for retaining cords 116 and maintaining cord 116 at a desired length. A user may utilize fasteners 122 to secure duvet cover 100 in the compact arrangement or at any desirable position while arranging the duvet insert for placement in duvet cover 100. Furthermore, when the duvet insert is desirably positioned within duvet cover 100, fastener 122 may assist in keeping duvet cover 100 in proper position.

In the embodiment shown in FIG. 4B having cord openings 126, the sequence of steps for positioning a duvet insert may slightly differ for embodiments of the duvet cover without cord openings 126. To position the duvet insert within duvet cover 100, a user may place duvet cover 100 over the duvet insert and may pull cords 116 from both sides to gather duvet cover 100 into a compact arrangement where bottom surface or edge 106 may be easily accessed. With bottom surface or edge 106 accessible, the user may connect duvet cover 100 to the duvet insert by connecting ties 112 connected to bottom surface or edge 106 to loops on one end of the duvet insert, thereby securing the duvet insert within duvet cover 100. The user can also connect the other end of the duvet insert to ties 112 in top surface 118 of duvet cover 100 and may close the opening 108. After the duvet insert is connected to ties 112 in bottom surface or edge 106, the user can pull on the ends of cords 116 that extend out of cord openings 126, and pull duvet cover 100 and attached insert away from bottom surface or edge 106, thereby pulling duvet cover 100 over the duvet insert in a uniform manner until the duvet insert is contained within duvet cover 100.

Accordingly, duvet cover 100 provides for fast, controlled, and uniform placement of duvet inserts within a duvet cover. A duvet insert may be positioned within duvet cover 100 more easily than in conventional duvet covers.

For ease of explanation, duvet cover 100 has been described using terms "top", "bottom", "side", "front", and "back" to define specific edges, surfaces, and sides of duvet cover 100. Such terms however should not be considered limiting and have been used for ease understanding of the underlying principles. For example, duvet cover 100 may have opening 108 defined at any side of duvet cover 100, e.g., top, bottom, left side, or right side. The skilled person would appreciate that the relative positioning of cord(s) 116 to opening 108, such as generally extending between an edge of duvet cover 100 having opening 108 and an edge remote to the edge of duvet cover 100 having opening 108 is what provides for improvement placement of duvet inserts within a duvet cover.

Additionally, although the described examples employ two cords 116, one cord 116 or a greater number of cords 116 may be employed instead. For example, single cord 116 may extend between an edge of duvet cover 100 having opening 108 and an edge remote to the edge of duvet cover 100 having opening 108, where cord 116 is positioned towards the middle of duvet cover 100, rather than adjacent to one of the sides. As another example, three or four spaced apart cord 116 may extend between an edge of duvet cover 100 having opening 108 and an edge remote to the edge of duvet cover 100 having opening 108. A greater number of cords would improve uniformity and controllability with which duvet cover 100 can be concertinaed, and then unfolded, particularly for duvet covers of a larger size.

Further, although duvet cover 100 is shown to be of a rectangular shape, similar principle can be applied to duvet covers of non-typical forms, such as duvet covers having more than four sides.

Further aspects of the present disclosure provide for a new design for a duvet cover, as described below and shown in the accompanying drawings.

Figure 9:
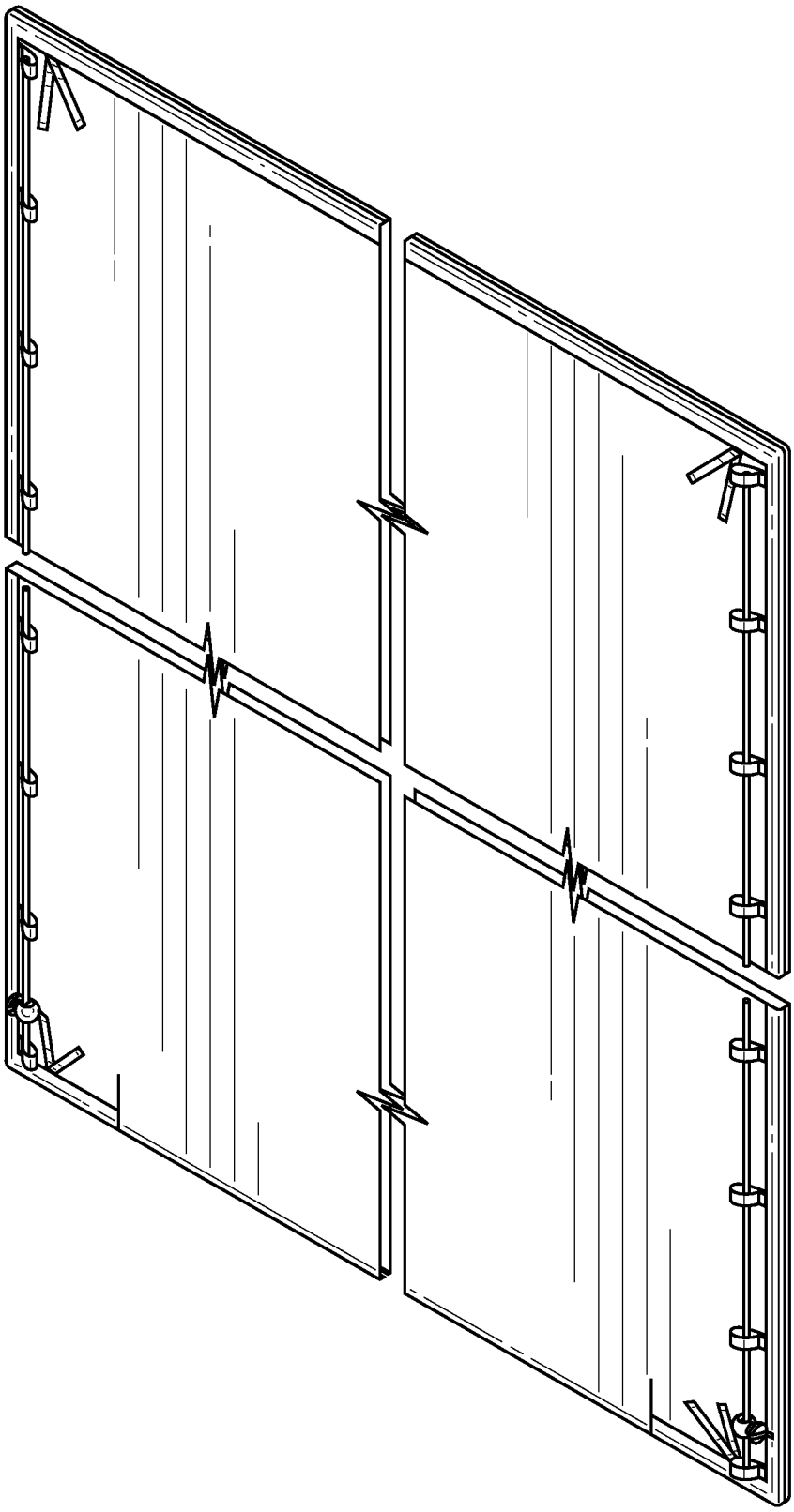
FIG. 9 is an interior front, top, right perspective view of a duvet cover, showing the new design.
Figure 10:
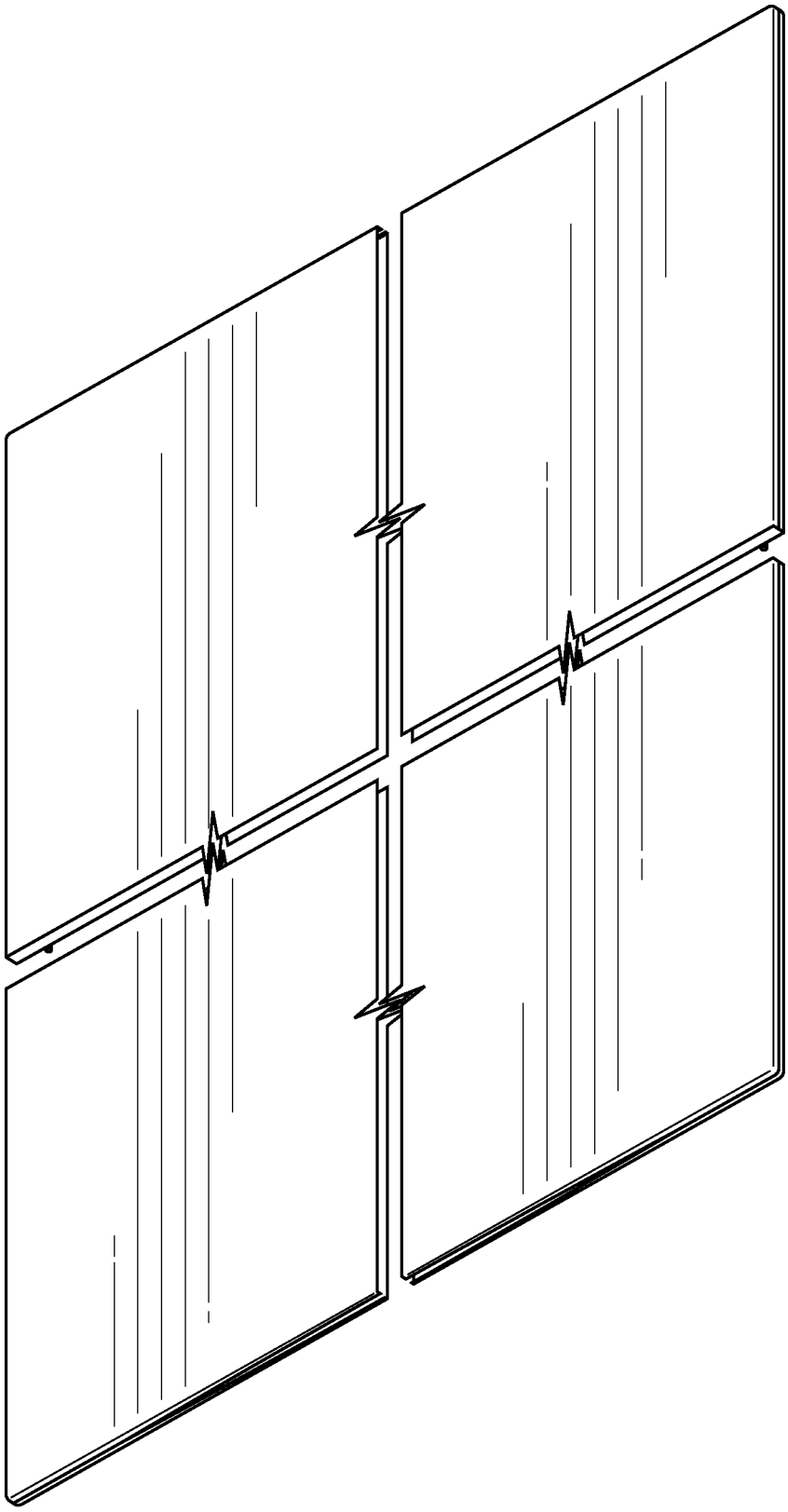
FIG. 10 is an interior rear, bottom, left perspective thereof.
Figure 11:
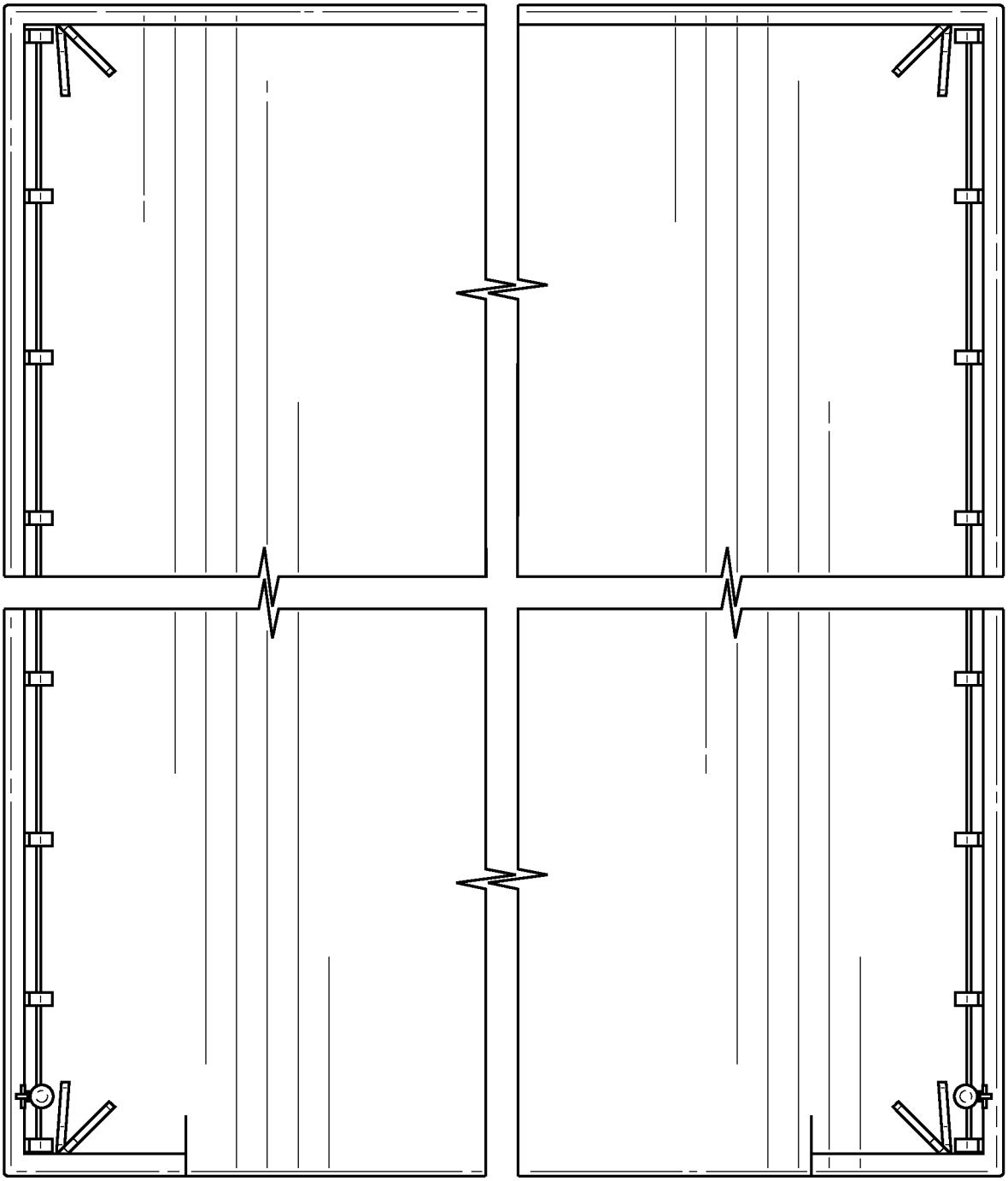
FIG. 11 is an interior front view thereof.
Figure 12:
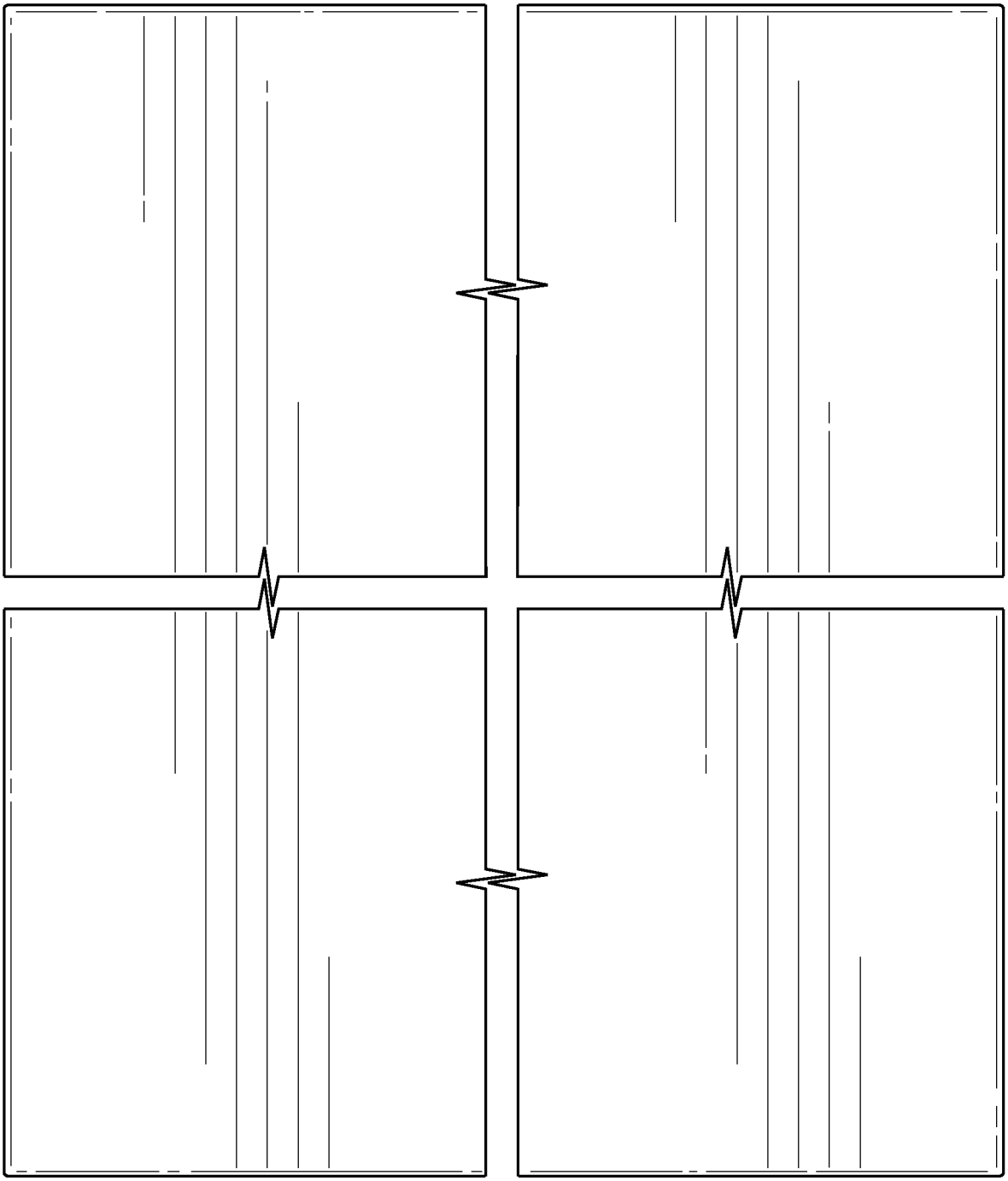
FIG. 12 is an interior rear view thereof.
Figure 13:
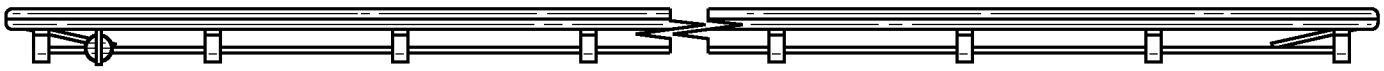
FIG. 13 is an interior left view thereof.
Figure 14:
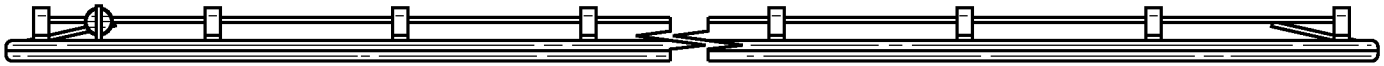
FIG. 14 is an interior right view thereof.
Figure 15:
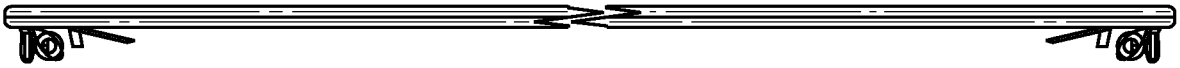
FIG. 15 is an interior top view thereof.

FIG. 9 is an interior front, top, right perspective view of a duvet cover, showing the new design;

FIG. 10 is an interior rear, bottom, left perspective thereof;

FIG. 11 is an interior front view thereof;

FIG. 12 is an interior rear view thereof;

FIG. 13 is an interior left view thereof;

FIG. 14 is an interior right view thereof;

FIG. 15 is an interior top view thereof; and

Figure 16:
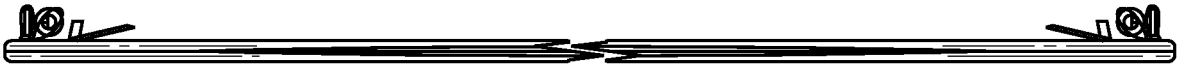
FIG. 16 is an interior bottom view thereof.

FIG. 16 is an interior bottom view thereof.

The foregoing description has been presented for purposes of illustration. It is not exhaustive and is not limited to precise forms or embodiments disclosed. Modifications and adaptations of the embodiments will be apparent from consideration of the specification and practice of the disclosed embodiments. In addition, while certain components have been described as being coupled to one another, such components may be integrated with one another or distributed in any suitable fashion.

Moreover, while illustrative embodiments have been described herein, the scope includes any and all embodiments having equivalent elements, modifications, omissions, combinations (e.g., of aspects across various embodiments), adaptations and/or alterations based on the present disclosure. The elements in the claims are to be interpreted broadly based on the language employed in the claims and not limited to examples described in the present specification or during the prosecution of the application, which examples are to be construed as nonexclusive. Further, the steps of the disclosed methods can be modified in any manner, including reordering steps and/or inserting or deleting steps.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and accordingly, all suitable modifications and equivalents may be resorted to, falling within the scope of the disclosure (e.g., slitted apertures, apertures, perforations may be used interchangeably maintaining the true scope of the embodiments)

Other embodiments will be apparent from consideration of the specification and practice of the embodiments disclosed herein. It is intended that the specification and examples be considered as example only, with a true scope and spirit of the disclosed embodiments being indicated by the following claims.

Also disclosed herein are the following clauses:

1. A duvet cover defines a cavity for receiving a duvet insert, the cavity accessible via an opening at a first edge of the duvet cover, the duvet cover comprising:

at least one cord inside the cavity within the duvet cover, the at least one cord extending between a second edge of the duvet cover, remote from the first edge of the duvet cover, and the first edge of the duvet cover, wherein a cord opening is defined in the duvet cover at the second edge for each of the at least one cord such the respective cord extends from within the cavity of the duvet cover through the cord opening; and a plurality of holders attached on the inside of the duvet cover, the plurality of holders holding the at least one cord such that pulling on a portion of the at least one cord at the cord opening causes at least a part of the first edge the duvet cover to be brought closer to the second edge of the duvet cover.

2. The duvet cover of clause 2, wherein:

the first edge and the second edge of the duvet cover are connected by a third edge and a fourth edge of the duvet cover;

the at least one cord comprises a first cord adjacent to the third edge of the duvet cover and a second cord adjacent to the fourth edge of the duvet cover; and pulling on a portion of each of the first and second cords at the cord opening, causes the third edge and the fourth edge of the duvet cover to concertina.

3. The duvet cover of clause 2, wherein the plurality of holders is a plurality of loops spaced along each of the third edge and fourth edge of the duvet cover and wherein the first and second cords are threaded through the corresponding loops.

4. The duvet cover of clause 3, wherein an equal number of the plurality of loops is uniformly spaced along each of the third edge and the fourth edge of the duvet cover.

5. The duvet cover of any of clause 2 to 4, wherein the duvet cover comprises a first layer and a second layer joined by seams along the third edge and the fourth edge to form the cavity of the duvet cover; and wherein the plurality of holders are attached on the inside of the duvet cover by being one or more of:

secured at the seams, in between the first layer and the second layer of the duvet cover, stitched to the first layer, stitched to the second layer, or stitched to the first and second layers.

6. The duvet cover of any of clauses 1 to 5 wherein the at least one cord is attached on the inside of the duvet cover at the first edge, or at the second edge, or at the first and second edges.

7. The duvet cover of any of clauses 1 to 6, comprising, for each of the at least one cord: a fastener coupled with the cord and configured to maintain the cord at a desired length.

8. The duvet cover of clause 7, wherein the fastener is a toggle, a clamp, a clip, or a tie.

9. The duvet cover of clause 8, wherein for each of the at least one cord, the fastener is attached on an outside of the duvet cover.

10. The duvet of any of clauses 7 to 9, wherein each fastener is attached to the duvet cover via a fastener tab secured at a seam joining a first layer and a second layer forming the cavity of the duvet cover.

11. The duvet cover of any of clauses 1 to 10, comprising a plurality of fixings attached on the inside of the duvet cover for assisting with keeping the duvet insert positioned inside the cavity of duvet cover, at least two of the plurality of fixings attached on the inside of the duvet cover proximate to the second edge of duvet cover.

12. The duvet cover of clause 11, wherein the plurality of fixings comprises at least two fixings attached proximate to the second edge.

13. The duvet cover of clause 11 or 12, wherein the plurality of fixings is a plurality of ties, clasps, clips, buttons, or any combination thereof positioned at corners of the duvet cover for coupling with corresponding loops positioned at corners of the duvet insert.

14. The duvet cover of any of clauses 1 to 13, wherein each of the at least one cord is made from cotton, polyester, blended fibers, or any combination thereof.

What is claimed is:

1. A duvet cover defining a cavity for receiving a duvet insert, the cavity accessible via an opening at a first edge of the duvet cover, the duvet cover comprising:

at least one cord inside the cavity within the duvet cover, the at least one cord extending between a second edge of the duvet cover, remote from the first edge of the duvet cover, and the first edge of the duvet cover; and a plurality of holders attached on an inside of the duvet cover, the plurality of holders holding the at least one cord such that pulling on a portion of the at least one cord, proximate to the opening, configured to cause at least a part of the second edge the duvet cover to be brought closer to the first edge of the duvet cover.

2. The duvet cover of claim 1, wherein:

the first edge and the second edge of the duvet cover are connected by a third edge and a fourth edge of the duvet cover;

the at least one cord comprises a first cord adjacent to the third edge of the duvet cover and a second cord adjacent to the fourth edge of the duvet cover; and pulling on a portion of each of the first and second cords, proximate to the opening, configured to cause the third edge and the fourth edge of the duvet cover to concertina.

3. The duvet cover of claim 2, wherein the plurality of holders is a plurality of loops spaced along each of the third edge and fourth edge of the duvet cover and wherein the first and second cords are threaded through the corresponding loops.

4. The duvet of claim 3, wherein an equal number of the plurality of loops is uniformly spaced along each of the third edge and the fourth edge of the duvet cover.

5. The duvet of claim 2, wherein the duvet cover comprises a first layer and a second layer joined by seams along the third edge and the fourth edge to form the cavity of the duvet cover; and wherein the plurality of holders are secured at the seams, in between the first layer and the second layer of the duvet cover.

6. The duvet of claim 2, wherein the duvet cover comprises a first layer and a second layer joined by seams along the third edge and the fourth edge to form the cavity of the duvet cover; and wherein the plurality of holders are stitched to the first layer, stitched to the second layer, or stitched to the first and second layers.

7. The duvet cover of claim 1, wherein the at least one cord is attached on the inside of the duvet cover at the first edge, at the second edge, or at the first and second edges.

8. The duvet cover of claim 1, comprising, for each of the at least one cord: a fastener coupled with the cord and configured to maintain the cord at a desired length.

9. The duvet cover of claim 8, wherein the fastener is a toggle, a clamp, a clip, or a tie.

10. The duvet cover of claim 8, wherein for each of the at least one cord:

the fastener is attached on the inside of the duvet cover.

11. The duvet cover of claim 8, wherein for each of the at least one cord:

a cord opening is defined in the duvet cover at the second edge and the respective cord extends from within the cavity of the duvet cover through the cord opening.

12. The duvet cover of claim 11, wherein for each of the at least one cord:

the corresponding fastener is coupled with the cord outside the cavity of the duvet cover.

13. The duvet cover of claim 11, wherein for each of the at least one cord, the fastener is attached on an outside of the duvet cover.

14. The duvet of claim 8, wherein each fastener is attached to the duvet cover via a fastener tab secured at a seam joining a first layer and a second layer forming the cavity of the duvet cover.

15. The duvet cover of claim 1, comprising a plurality of fixings attached on the inside of the duvet cover for assisting with keeping the duvet insert positioned inside the cavity of duvet cover.

16. The duvet cover of claim 15, wherein at least two of the plurality of fixings are attached on the inside of the duvet cover proximate to the second edge of duvet cover.

17. The duvet cover of claim 16, wherein the plurality of fixings comprises at least two fixings attached proximate to the first edge.

18. The duvet cover of claim 15, wherein the plurality of fixings is a plurality of ties, clasps, clips, buttons, or any combination thereof.

19. The duvet cover of claim 18, wherein the plurality of fixings are positioned at corners of the duvet cover for coupling with corresponding loops positioned at corners of the duvet insert.

20. The duvet cover of claim 1, wherein each of the at least one cord is made from cotton, polyester, blended fibers, or any combination thereof.

* * * * *